United States Patent [19]

Johnston

[11] Patent Number: 4,566,749

[45] Date of Patent: Jan. 28, 1986

[54] ELECTRICAL CONNECTOR RECEPTACLE

[75] Inventor: James J. Johnston, Old Saybrook, Conn.

[73] Assignee: Brand-Rex Company, Willimantic, Conn.

[21] Appl. No.: 639,242

[22] Filed: Aug. 9, 1984

[51] Int. Cl.[4] ..... H01R 11/05

[52] U.S. Cl. ..... 339/95 D; 339/176 M; 339/206 R

[58] Field of Search ..... 339/95 D, 206 R, 210 R, 339/210 M, 176 M

[56] References Cited

U.S. PATENT DOCUMENTS

| | | | |
|---|---|---|---|
| 2,883,641 | 4/1959 | Despard | 339/95 D |
| 3,757,277 | 9/1973 | Yamanoue et al. | 339/176 M |
| 4,114,975 | 9/1978 | Weidler | 339/176 M |
| 4,256,358 | 3/1981 | Genz | 339/95 D |
| 4,367,908 | 1/1983 | Johnston | 339/176 M |
| 4,477,141 | 10/1984 | Hardesty | 339/176 M |

*Primary Examiner*—John McQuade

*Attorney, Agent, or Firm*—McCormick, Paulding & Huber

[57] ABSTRACT

A modular electrical connector receptacle includes a dielectric housing containing a plurality of unitary resilient formed spring wire contacts for terminating bare end portions of a plurality of solid wire conductors inserted into the housing and interfacing with a modular plug connector disposed within a plug receiving recess in the housing.

11 Claims, 11 Drawing Figures

ELECTRICAL CONNECTOR RECEPTACLE

BACKGROUND OF THE INVENTION

This invention relates in general to electrical connectors and deals more particularly with an improved modular electrical connector receptacle or jack for terminating a plurality of individually insulated solid conductors and interfacing with an associated connector plug. The present invention is particularly concerned with an improved high density modular receptacle of a type in wide spread use in the telecommunication industry and which includes a dielectric housing containing a plurality of unitary spring contact members adapted to interface directly with contacts on an industry standard plug.

The development of new electronic telephone systems, including key telephone units and associated cable distribution networks, has created need for improved means for terminating two, three and four pair cables containing solid wire conductors into FCC controlled industry standard receptacle interface. Heretofore, adaptors employing standard termination technology have been employed for conversion from hard wired connection to plug receptacle interface. However, the use of such existing technology has generally resulted in a substantial increase in the number of conductor terminations required to complete conversion. Further, the industry standard receptacles are generally sized to receive plug connectors for two, three or four pair cables. The inadvertent connection of an improper plug with a receptacle may result in damage to contacts within the receptacle.

Accordingly, it is the general aim of the present invention to provide an improved high density receptacle or jack for factory and field termination of solid conductors directly to receptacle contacts for interface with an industry standard modular plug. It is a further aim of the present invention to provide an improved receptacle for direct termination and which will not be damaged by erroneous insertion of an improperly matched plug.

SUMMARY OF THE INVENTION

In accordance with the present invention, an improved electrical connector receptacle has a dielectric housing defining a longitudinally extending forwardly opening plug receiving cavity. A plurality of unitary resilient spring compact members are disposed within the housing. Each of the contact members has a front end, a reversibly upwardly bent rear end, an arcuately upwardly bowed contact portion intermediate its front and rear ends, and a terminal portion inclined forwardly and upwardly from the reversely bent rear end portion of the contact and terminating at a free end. Means is provided for electrically isolating the contacts members and maintaining the contact members within the housing in closely spaced apart side-by-side relation to each other. A means is also provided for supporting the front end portion and the rear end portion of each contact member within the housing. The receptacle further includes means for defining a reaction surface within the housing associated with each free end and against which the free end exerts biasing force.

DETAILED DESCRIPTION OF PREFERRED EMBODIMENT

The modular electrical connector receptacle of the present invention is particularly adapted to directly terminate a circuit distribution cable or the like, which includes a plurality of solid conductors, and to interface with a modular plug connector of a type currently in wide-spread use in the telecommunication industry, to establish electrical connection between the various conductors and contacts on the plug connector. The receptacle essentially comprises a dielectric housing which contains a plurality of unitary resilient formed metal contacts and has openings at one end to receive prestripped end portions of a plurality of individually insulated solid conductors which comprise a distribution cable. Another opening in the opposite end of the housing receives a modular plug connector in plugging engagement therein.

Figure 1:
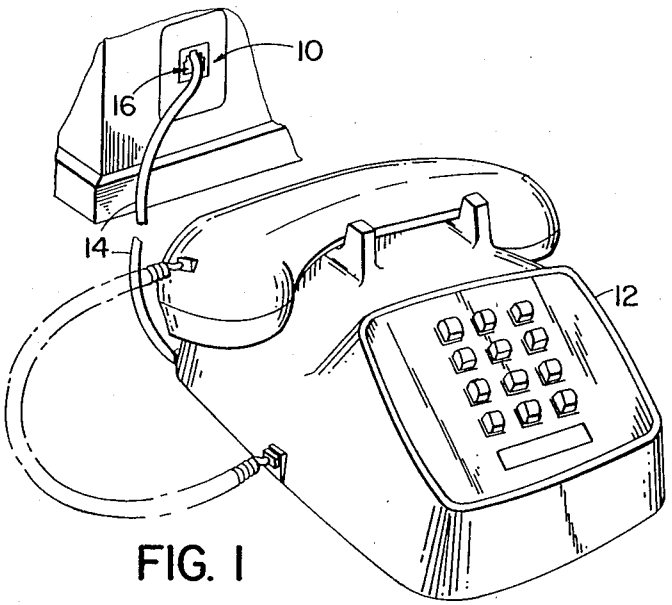
FIG. 1 is a perspective view of a telephone shown connected in plugging engagement with a wall mounted modular receptacle embodying the present invention.
Figure 6:
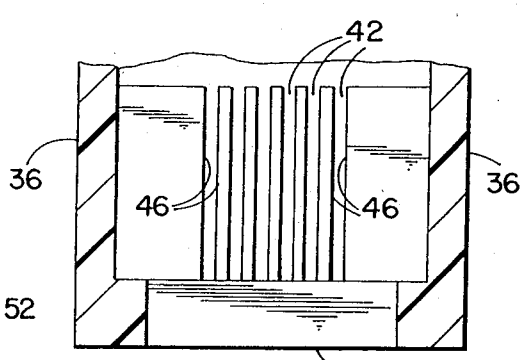
FIG. 6 is a fragmentary sectional view taken along the line 6—6 of FIG. 4.

A typical telephone installation, shown in FIG. 1, includes a telephone connected to a wall outlet adaptor which comprises a modular connector receptacle embodying the present invention. The illustrated receptacle is indicated generally by the reference numeral 10. The telephone, indicated at 12, has a line cord 14 connected at one end to its base. A modular plug, indicated generally at 16, and attached to the opposite end of the line cord, is releasably retained in plugging engagement within the receptacle 10, as best shown in FIG. 2, and hereinafter further described.

The illustrated plug 16 comprises a conventional industry standard modular plug. However, before considering the modular receptacle 10 in further detail, the plug will be generally described. The plug 16 has a generally rectangular unitary body 18 molded from resilient dielectric plastic material. A plurality of spade contacts 20, 20 (one shown), connected to individually insulated electrical conductors which comprise the line cord 14 and supported in spaced apart side-by-side relation to each other, have contact surfaces exposed along one side of the body, substantially as shown. More specifically, the plug body 18 has a plurality of substantially parallel side-by-side channels 22, 22 (one shown), which open through the free end and through one side of the plug body 18. Each spade contact 20 projects into an associated channel 22 and has its contact surface exposed within the latter channel.

Figure 2:
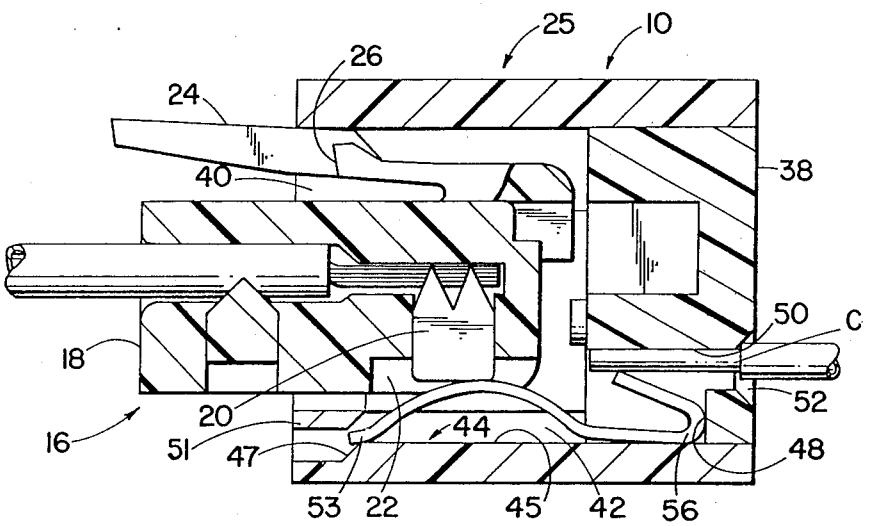
FIG. 2 is a somewhat enlarged sectional view through the modular receptacle of FIG. 1 shown connected to an insulated electrical cable and having a modular plug engaged therein.
Figure 9:
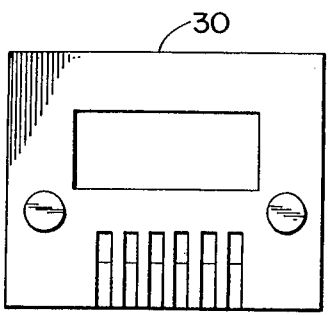
FIG. 9 is a front end view of the receptacle insert shown in FIG. 9.
Figure 3:
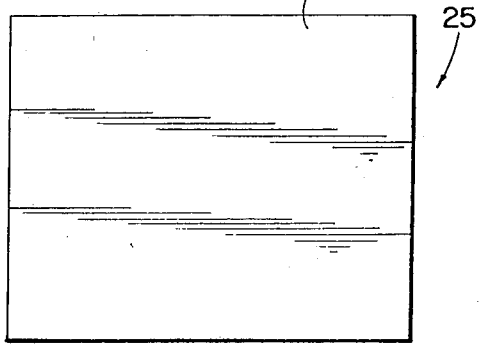
FIG. 3 is a side elevational view of the modular receptacle shown in FIG. 2.

A resilient latching tab 24, is integrally connected to the upper surface of the body 18, as it appears in FIG. 2 and biased upwardly toward a latching position, has a pair of transversely spaced apart and generally rearwardly facing retaining shoulders 26,26 (one shown in FIG. 2 for cooperating with opposing retaining shoulders on the plug receptacle 10 in a manner well known in the art. A detailed disclosure of a modular plug connector of the aforedescribed general type is found in U.S. Pat. No. 3,617,982 to Hardesty, issued Nov. 2, 1971, assigned to Western Electric Company, Inc., and hereby adopted by reference as part of the present invention.

Referring now particularly to FIGS. 2–8, the illustrated modular recepticle 10 has a generally rectangular housing indicated generally by the numeral 25 and containing a plurality of resilient spring contacts members 27, 27. The housing may comprise a single part molded from durable, high impact, heat resistent, dielectric plastic material. However, to facilitate economical molding and assembly the illustrated housing is preferably made from two parts and includes a body 28 and an insert 30, best shown in FIG. 8. The housing has a top wall 32, a bottom wall 34, and a pair of opposing side walls 36,36. The insert 30 cooperates in assembly with the top, bottom, and side walls to define a housing rear wall 38. The housing walls further cooperate to define a generally rectangular longitudinally forwardly opening plug receiving cavity 40. The upper portion of the cavity 40 is defined by an upwardly stepped recess in the top wall 32 (best shown in FIG. 4) for receiving the latching tab 24. Rearwardly facing shoulders 41, 41 formed on the housing, engage the shoulders 26, 26 on the latching tab in a manner well known in the art.

A plurality of contact receiving channels 42, 42, are formed in the bottom and rear wall (one shown in FIG. 2) and communicate with the plug receiving cavity 40. Each channel 42 has an upwardly facing lower surface which is generally indicated at 44 and includes a main part 45 and a ramp surface 47 which forms a first junction with the main part 45. The ramp surface is forwardly and downwardly inclined from the first junction and away from the main part. Each channel further includes a pair of opposing side surface 46, 46 and a forwardly facing rear surface 48 which forms a junction with the main part of lower surface 44. Each channel also has a downwardly facing upper surface 50 defined by the rear wall 38. A retaining member 51 extends across the forward end of each channel above the ramp surface 47.

Figure 5:
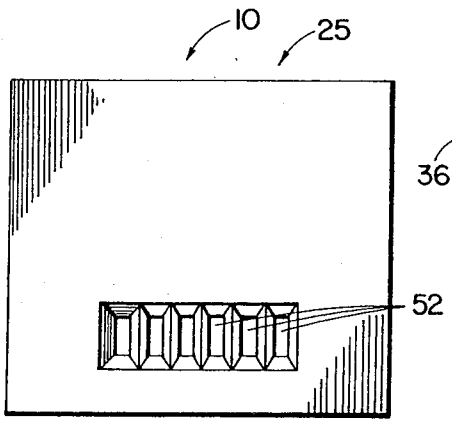
FIG. 5 is a rear end view of the modular receptacle.
Figure 4:
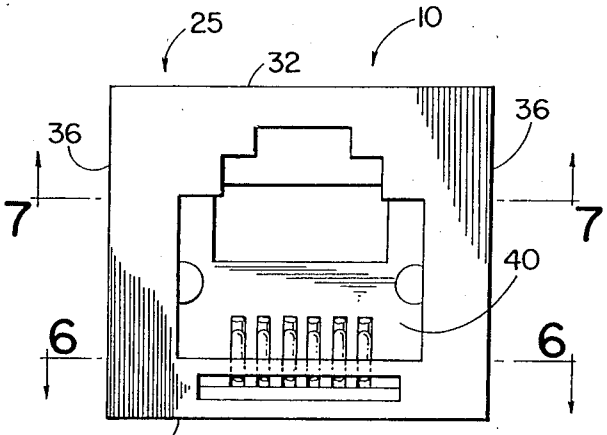
FIG. 4 is a front end view of the modular receptacle.

A plurality of apertures 52, 52 are formed in the rear wall 38. Each aperture 52 cooperates with the rear portion of an associated channel 42. The upper wall of each aperture 52 is preferably aligned with an associated channel upper surface 50, substantially as shown in FIG. 2. The rear end of each aperture is defined by rearwardly outwardly diverging guide surfaces, as best shown in FIGS. 2 and 5.

Figure 10:
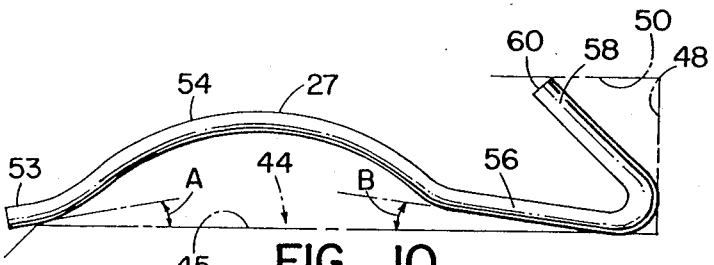
FIG. 10 is a somewhat further enlarged side elevational view of a typical unitary spring contact member.

A typical spring contact member 27 is shown in FIG. 10 relative to a lower support surface 44 shown in phanthom. The resilient metal contact spring is preferably formed from cylindrical spring wire and has a front end portion 53 which is supported on and inclined upwardly and rearwardly from the lower surface main part 45. The included angle between the front end portion 53 and the surface 44, indicated by the letter A in FIG. 10, is at least 5 degrees and not more than 15 degrees. However, a 10 degree included angle is presently prefered. An arcuately upwardly bowed contact portion 54 is intregally connected at its forward end to the rear end of the front end portion 53. Preferably, and as shown, the arcuate contact portion has a center of curvature located some distance below the housing. A rear transitional portion 56 is integrally connected at its forward end to the rear end of the contact portion 54 and extend downwardly and rearwardly therefrom. The included angle between the transitional portion and the surface 44, indicated by the letter B in FIG. 10, is at least 5 degrees and not more than 15 degrees. However, a 10 degree included angle is presently prefered. The transitional portion 56 has a reversely upwardly bent rear end portion which is supported at the second junction formed by the lower surface 44 and the forwardly facing rear surface 48. Each spring contact 27 further includes a rear terminal portion 58 integrally connected at its rear end to a forward end of the reversely bent portion. The rear terminal portion 58 extends generally forwardly and upwardly relative to the junction formed by the wall surface 44 and 48 and terminates at a free end 60. In assembly the terminal portion 58 is deflected from its broken line position **58*a* to its broken line position 58*b*, shown in FIG. 11, wherein it exerts substantial biasing force upon the upper surface 50**.

Figure 11:
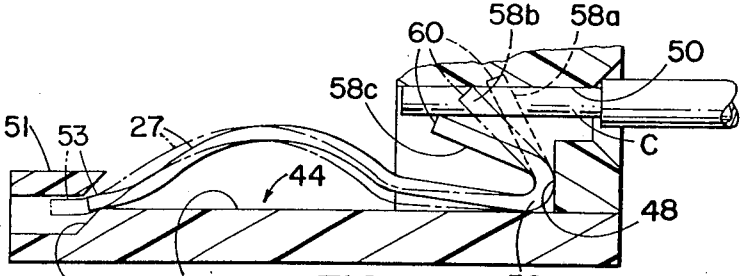
FIG. 11 is a somewhat enlarged fragmentary longitudinal sectional view of the modular receptacle as it appears in FIG. 2.
Figure 7:
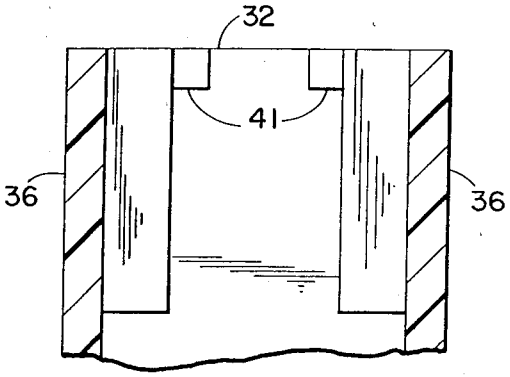
FIG. 7 is a fragmentary sectional view taken along the line 7—7 of FIG. 4.
Figure 8:
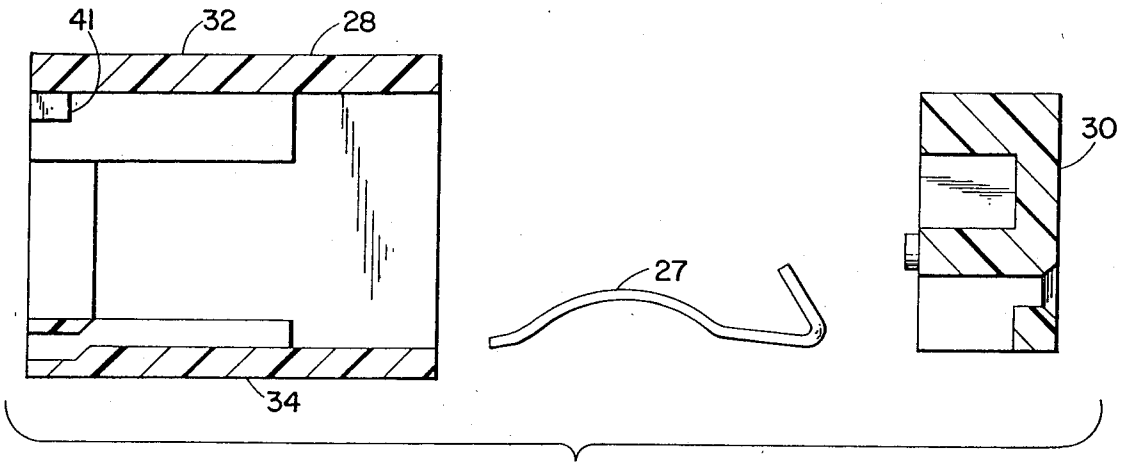
FIG. 8 is an exploded longitudinal sectional view of the modular receptacle.

The illustrated receptacle 10 is particularly adapted for terminating a distribution cable having three pair of insulated conductors. A single conductor is shown in FIGS. 2 and 11 and indicated by the letter C. Preparatory to terminating the conductors, the terminal end of each conductor C is prestripped as shown. The prestripped end portion of each conductor C is then inserted into an associated aperture 52 and forced into an associated channel 42 to a position wherein the terminal end 58 is deflected downwardly from its broken line position **58*b* to a position 58*c* shown in full lines in FIG. 11, so that the bare end portion of the conductor C is trapped between the upper surface 50 and the free end portion 60. The upwardly directed biasing force exerted by the free end portion 60 in the direction of the upper surface 50 is sufficient to incise or nich an associated portion of the somewhat softer bare end portion of the conductor C whereby to establish a clean, gas tight connection therebetween. When each of the conductors has been connected to an associated spring contact member in the latter manner, the receptacle 10** is ready for use.

Insertion of a proper plug connector, such as the plug connector 16, into the plug receiving cavity 40 cause the contact surfaces on the lower ends of the spade contact 20, 20 to engage the upwardly bowed contact portions 54, 54. Insertion of the plug contact brings a contact surface on each spade contact into wiping engagement with an associated arcuate contact portion 54. The arcuate contact portions are shaped to assure sufficient deflection by insertion of the plug and thereby provide a substantially clean gas tight connection.

If an improper plug connector is inserted into the plug receiving aperture 40, as, for example, a plug having two pair of contacts, the two outboard contacts on the receptacle may be depressed to a somewhat greater degree than the other contacts in the receptacle by engagement with solid portions of the plug body. When this condition occurs, each affected contact member (i.e. the outboard contact members in the receptacle) will move down the ramp surface 47 and under the retaining member 51 to the broken line position shown in FIG. 11 so that damage to these contacts will be avoided. The contacts are sufficiently resilient to return to the unstressed position shown in full lines in FIG. 11 when the improper plug is removed from the receptacle 10.

In this specification and in the claims which follow the terms top, bottom, front and rear are employed for convenience in describing the receptacle 10, as it appears oriented in the drawing. However, it should be understood that the receptacle may be used in any orientation. The aforesaid terms should not be construed to limit the receptacle to use in its illustrated orientation.

I claim:

1. An electrical connector receptacle comprising a dielectric housing having top, bottom, side, and rear walls defining a generally rectangular longitudinally extending forwardly opening plug receiving cavity, said bottom and rear walls cooperating to define a plurality of contact receiving channels communicating with said plug receiving cavity, each of said channels having an upwardly facing lower surface including a main portion and a ramp portion forming a first junction with said main portion and inclined forwardly and downwardly from said first junction and away from said main portion, a pair of opposing side surfaces and a forwardly facing rear surface forming a second junction with said lower surface, said rear wall further defining an upper surface of each of said channels, a plurality of unitary resilient spring contact members supported in generally parallel side-by-side relation to each other within said housing, each of said contact members being disposed within an associated one of said channels between said side surface thereof, each of said contact members having a front end portion supported on said main portion proximate said first junction and inclined upwardly and rearwardly from said main portion, an arcuately upwardly bowed contact portion integrally connected at its forward end to the rear end of said front end portion for engaging an associated plug contact on a plug having a body supporting the plug contact and received within said cavity, a rear transitional portion integrally connected at its forward end to the rear end of said contact portion and extending downwardly and rearward therefrom, said transitional portion including an upwardly reversely bent rear end portion supported at said second junction by said lower surface and said forwardly facing rear surface, and a rear terminal portion integrally connected at its rear end to a forward end of said reversely bent rear end portion and extending generally forwardly and upwardly away from said second junction and terminating at a free end, said free end exerting biasing force upon said upper surface, and a plurality of connector receiving apertures extending through said rear wall, each of said apertures communicating with an associated one of said channels said front end portion of each contact member engaged with an associated contact on a plug received within said housing being supported by said main portion, said front end portion of each contact member engaged with an associated portion of the body of a plug received within said cavity being generally supported by said ramp portion forward of said first junction.

2. An electrical connector receptacle as set forth in claim 1 wherein each of said apertures communicates with an associated channel approximate said upper surface.

3. An electrical connector assembly as set forth in claim 1 wherein said contact members are formed from cylindrical spring wire.

4. An electrical connector receptacle as set forth in claim 1 including means for maintaining said contact members in substantially fixed position relative to said housing.

5. An electrical connector receptacle as set forth in claim 4 wherein said retaining means comprises a retaining member extending across each channel proximate said first junction.

6. An electrical connector receptacle as set forth in in claim 5 wherein said ramp portion is located below said retaining member.

7. An electrical connector receptacle as set forth in claim 1 wherein the included angle between said front portion and said main portion is at least 5 degrees and not greater than 15 degrees.

8. An electrical connector receptacle as set forth in claim 7 wherein said including angle comprises 10 degrees.

9. An electrical connector receptacle as set forth in claim 1 wherein the included angle between said transition portion and said main portion is at least 5 degrees but not greater than 15 degrees.

10. An electrical connector receptacle as set forth in claim 9 wherein said included angle comprises 10 degrees.

11. An electrical connector receptacle as set forth in claim 1 wherein said arcuate contact portion has a radius of curvature the center of which is located below said housing.

* * * * *